US007850497B2

(12) United States Patent
Kang

(10) Patent No.: US 7,850,497 B2
(45) Date of Patent: Dec. 14, 2010

(54) METHOD AND SYSTEM FOR PROVIDING AND USING A POWER PADDLE

(75) Inventor: Alan H. I. Kang, 583 Kamoku St., Apt. 3207, Honolulu, HI (US) 96828

(73) Assignee: Alan H. I. Kang, Honolulu, HI (US)

( * ) Notice: Subject to any disclaimer, the term of this patent is extended or adjusted under 35 U.S.C. 154(b) by 144 days.

(21) Appl. No.: 12/203,716

(22) Filed: Sep. 3, 2008

(65) Prior Publication Data

US 2010/0056000 A1 Mar. 4, 2010

(51) Int. Cl.
*B63H 16/04* (2006.01)

(52) U.S. Cl. ..... 440/101

(58) Field of Classification Search ..... 440/101; 416/231 R; 454/33, 219, 222, 295, 335
See application file for complete search history.

(56) References Cited

U.S. PATENT DOCUMENTS 802,013 A * 10/1905 Morse ..... 454/222
1,786,451 A * 12/1930 Ribard ..... 416/74
3,606,572 A * 9/1971 Schwedland ..... 416/90 R
4,480,829 A * 11/1984 Yacoboski ..... 482/111
4,913,418 A 4/1990 Schlueter et al.
5,511,998 A 4/1996 Johnson
5,842,830 A * 12/1998 Franznick ..... 416/74
6,042,438 A 3/2000 Dean
6,325,727 B1 12/2001 Carr
7,717,812 B2 * 5/2010 Winger ..... 473/451
2004/0116256 A1 6/2004 Stout et al.
2004/0197754 A1 10/2004 Coppelli

* cited by examiner

*Primary Examiner*—Stephen Avila
(74) *Attorney, Agent, or Firm*—Convergent Law Group LLP

(57) ABSTRACT

A paddle and a method for using the paddle are described. The method and system include providing a first resistance surface and at least a second resistance surface. The first resistance surface includes at least one aperture therein. The second resistance surface(s) are coupled with the first resistance surface in a plurality of configurations. The plurality of configurations has a plurality of resistances.

18 Claims, 5 Drawing Sheets

METHOD AND SYSTEM FOR PROVIDING AND USING A POWER PADDLE

BACKGROUND OF THE INVENTION

In order to improve performance in sporting events improved strength is often desirable. An increase in strength is typically achieved through resistance training. For example some form of weight training is generally employed. In addition to an increase in power, an increase in speed may also be desired. Stated differently, training of both fast twitch and slow twitch muscles may be desired.

However, in many water sports, at least some of this training may be problematic. For example, training for increased power may be is difficult. In paddling, rowing, or any water sport that requires a paddle or oar, longer training sessions are typically employed. Such long session may be tedious and/or may be difficult to schedule. Consequently, an improved mechanism for training is desired.

BRIEF SUMMARY OF THE INVENTION

A method and system for providing and using a paddle are described. The method and system include providing a first resistance surface and at least a second resistance surface. The first resistance surface includes at least one aperture therein. The second resistance surface(s) are coupled with the first resistance surface in a plurality of configurations. The plurality of configurations has a plurality of resistances.

According to the method and system disclosed herein, the paddle might be configured for power and/or speed workouts.

DETAILED DESCRIPTION OF THE INVENTION

The method and system relate to paddle. The following description is presented to enable one of ordinary skill in the art to make and use the invention and is provided in the context of a patent application and its requirements. Various modifications to the embodiments and the generic principles and features described herein will be readily apparent to those skilled in the art. Thus, the method and system are not intended to be limited to the embodiments shown, but is to be accorded the widest scope consistent with the principles and features described herein.

The method and system are mainly described in terms of particular systems provided in particular implementations. However, one of ordinary skill in the art will readily recognize that this method and system will operate effectively in other implementations. For example, the systems and devices such as paddles, including various resistance surfaces, may take a number of different forms. The method and system will also be described in the context of particular methods having certain steps. However, the method and system operate effectively for other methods having different and/or additional steps not inconsistent with the method and system.

Figure 1:
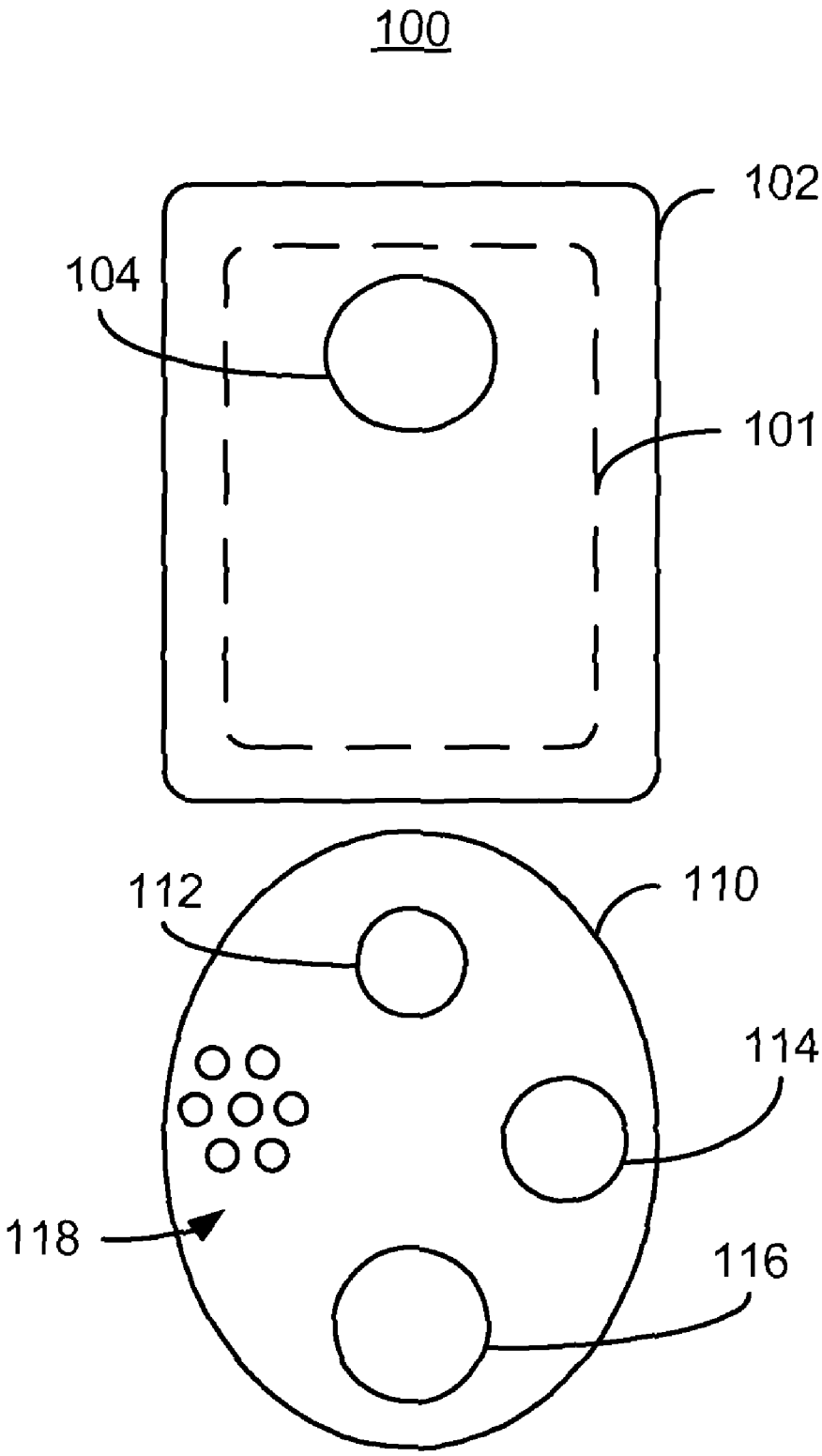
FIG. 1 depicts a portion of an exemplary embodiment of a paddle.

FIG. 1 depicts a portion of an exemplary embodiment of a paddle 100. The paddle 100 includes resistance surfaces 102 and 110. In one embodiment one or both of the resistance surfaces 102 and 110, such as the resistance surface 102, is coupled to or incorporates a shaft. The paddle 100 may be a canoe paddle, a kayak paddle, a paddle-surfing paddle, surf ski paddle, or other paddle/oar.

The resistance surface 102 includes aperture 104. In one embodiment, the resistance surface is larger than a conventional paddle (not shown) that would be employed by the user of the paddle 100. For example, the dashed line 101 indicates the size of such a conventional paddle. However, in another embodiment, the resistance surface 102 is the same size as the conventional paddle. In an alternate embodiment, the resistance surface 102 might be smaller than that of a conventional paddle.

The resistance surface 102 has an aperture 104 therein. Although one aperture 104 is shown, another number might be used. The second resistance surface 110 includes multiple sets of apertures 112, 114, 116, and 118. The apertures 112, 114, 116, and 118 have different sizes. The resistance surface 102 and the resistance surface 110 may be coupled in a variety of configurations. In particular, the resistance surface 110 may be coupled with the resistance surface 102 such that the apertures 104 and 112 are aligned, such that the apertures 104 and 114 are aligned, such that the apertures 104 and 116 are aligned, or such that the apertures 104 and 118 are aligned. In one embodiment, the resistance surface 102 may be coupled with the resistance surface 110 such that no apertures are aligned. In one embodiment, the alignment may be achieved by detaching the resistance surface 102 from the resistance surface 110, then reattaching the resistance surfaces 102 and 110 in the desired configuration. In another embodiment, the resistance surface 102 and 110 are rotatably coupled. In such an embodiment, one resistance surface 102 or 110 may be rotated with respect to the other resistance surface 110 or 102, respectively, and then engaged when the resistance surfaces 110 and 102 are in the desired configuration.

Based on whether and which apertures are aligned, the resistance provided by the paddle 100 may be changed. For example, if no apertures are aligned, the paddle has the highest resistance. In one embodiment, this resistance may be one hundred twenty-five percent through one hundred fifty percent of the resistance of a corresponding conventional paddle. If the apertures 104 and 118 are aligned, the paddle 100 has the next highest resistance. If the apertures 104 and 112 are aligned, then the paddle has a third highest resistance. If the apertures 104 and 114 are aligned, then the paddle has a fourth highest resistance. If the apertures 104 and 116 are aligned, then the paddle has a fifth highest (i.e., the lowest) resistance. In one embodiment, this resistance is at least fifty percent of the resistance of the corresponding conventional paddle. In one embodiment, this resistance is at least seventy-five through eighty percent of the resistance of the corresponding conventional paddle. However, other resistances may be achieved in this or other embodiments.

By utilizing the paddle 100 in one of the configurations, a user may achieve a variety of training goals. If the resistance surface 102 and/or 110 is greater in size than a conventional paddle, the highest resistance is greater than the resistance of a conventional paddle. Such a configuration may be useful for strength training for the particular activity employing the paddle. This is because the user will encounter greater resistance than when using their conventional paddle. The lowest resistance configuration may have a resistance less than that of a corresponding conventional paddle. In such an embodiment, the user may be better able to train fast twitch muscles, for example for sprints in the particularly activity. This is because a user may be better able to perform faster strokes at the desired depth using the lower resistance configuration. Resistances between the highest and lowest may be used to achieved some combination of results and/or be used for individuals having less experience, less strength, slower strokes, and/or for other purposes. Further, because a paddle 100 is used, the user's motion when training with the paddle 100 may be closer to that required for execution of their sport. As a result, the user may enjoy greater specificity of exercise, or motions closer to that for their chosen activity, when performing strength or sprint training. Consequently, the user's training may be better tailored to the desired activity.

Using the paddle 100, therefore, a user such as an athlete may be better able to achieve their training goals. Because the varying resistance configurations may be more readily obtained using the resistance surface 102 and 110, the paddle 100 may be used for different training goals and is, therefore, more flexible. Moreover, because the user may simply rotate and engage or detach than reattach the surface 102 and 110, the user's preparation for training is simplified. Further, because multiple resistances may be achieved with a single paddle 100, the user need not purchase, maintain, and transport multiple pieces of equipment for varied resistance training. Consequently, cost and ease of use may be improved.

Figure 2:
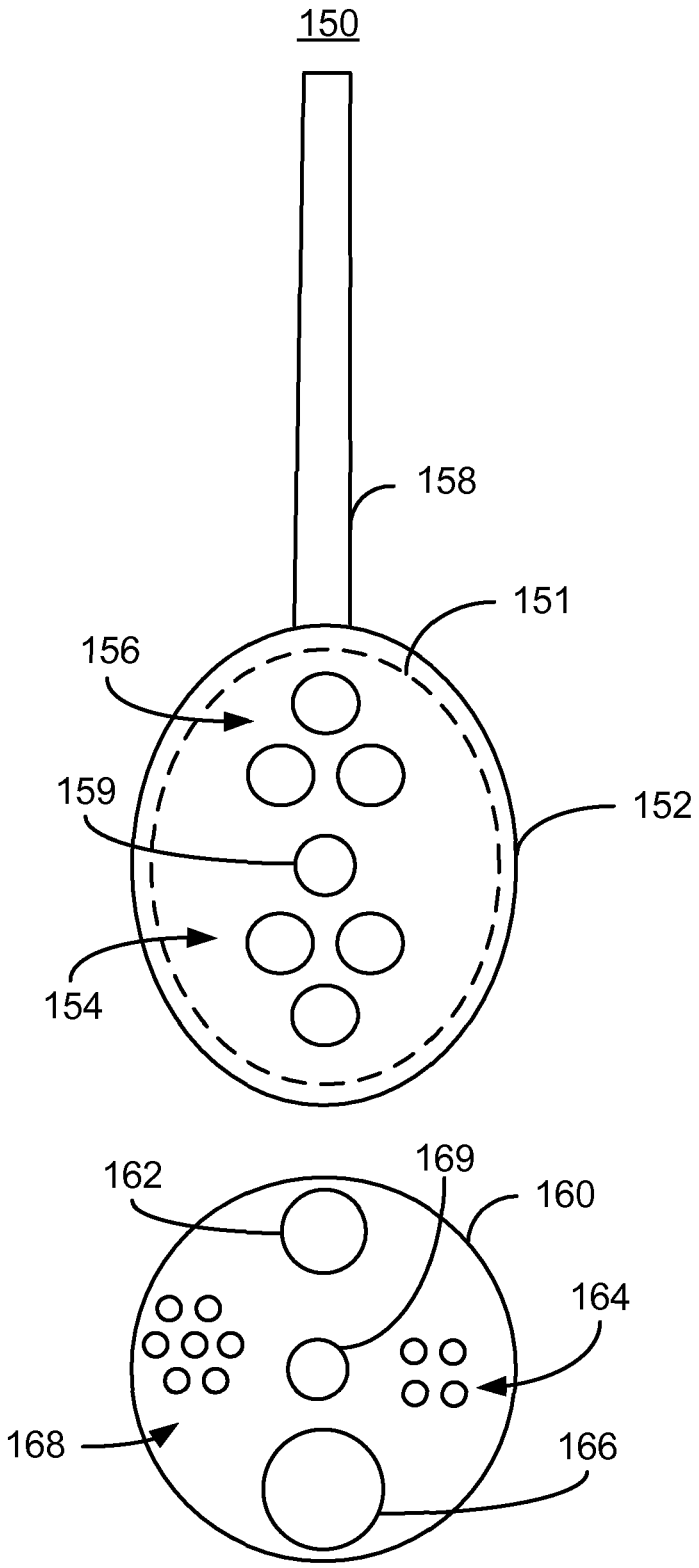
FIG. 2 depicts another exemplary embodiment of a paddle.

FIG. 2 depicts another exemplary embodiment of a paddle 150. The paddle 150 includes resistance surfaces 152 and 160 as well as a shaft 158. In the embodiment shown, the resistance surface 152 is connected to the shaft 158. In another embodiment both of the resistance surfaces 152 and 160 may be coupled to coupled to or incorporate a shaft. In yet another embodiment, the resistance surface 160 may be coupled to the shaft 158. The paddle 150 may be a canoe paddle, a kayak paddle, a paddle-surfing paddle, surf ski paddle, or other paddle/oar.

The resistance surface 152 includes apertures 154, apertures 156, and central region 159. The central region 159 may be used to rotatably couple the resistance surface 152 with the resistance surface 160. In one embodiment, the resistance surface 152 is larger than a conventional paddle (not shown) that would be employed by the user of the paddle 150. For example, the dashed line 151 indicates the size of such a conventional paddle. However, in another embodiment, the resistance surface 152 is the same size as the conventional paddle. In an alternate embodiment, the resistance surface 152 might be smaller than that of a conventional paddle. In the embodiment shown, each set of apertures 154 includes three apertures. However, in another embodiment, another number of apertures, as well as another number of sets of apertures, might be used.

The resistance surface 160 includes multiple sets of apertures 162, 164, 166, and 168 as well as a central region 169. The central region 169 may house or couple with a shaft (not shown) used to rotatably couple the resistance surface 152 and 160. The apertures 162, 164, 166, and 168 have different sizes. The resistance surface 152 and the resistance surface 160 may be coupled in a variety of configurations. In particular, the resistance surface 160 may be coupled with the resistance surface 152 such that the apertures 154 and 162 and apertures 156 and 166 are aligned. Similarly, the resistance surface 160 may be coupled with the resistance surface 152 such that the apertures 154 and 166 and the apertures 156 and 162 are aligned. The resistance surface 160 may be coupled with the resistance surface 152 such that the apertures 154 and 164 and apertures 156 and 168 are aligned. Similarly, the resistance surface 160 may be coupled with the resistance surface 152 such that the apertures 154 and 168 and the apertures 156 and 164 are aligned.

In one embodiment, the resistance surface 102 and 110 are rotatably coupled through regions 159 and 169, respectively. In such an embodiment, one resistance surface 102 or 110 may be rotated with respect to the other resistance surface 110 or 102, respectively, then engaged when the resistance surfaces 110 and 102 are in the desired configuration. In another embodiment, the alignment may be achieved by detaching the resistance surface 152 from the resistance surface 160, then reattaching the resistance surfaces 152 and 160 in the desired configuration.

Based on whether and which apertures are aligned, the resistance provided by the paddle 150 may be changed. The resistances available are analogous to the resistance described for the paddle 100. For example, resistances as low as fifty percent and/or seventy-five through eighty percent of a conventional paddle and as high as one hundred twenty-five through one hundred-fifty percent of a conventional paddle may be obtained. In other embodiments, different resistances may be achieved. Consequently, similar benefits may be achieved. By utilizing the paddle 150 in one of the configurations, a user may achieve a variety of training goals. In particular higher resistances may allow for greater strength training while lower resistances may facilitate better fast twitch muscle/sprint training. Variations in resistances may also be used to achieved some combination of strength and speed results and/or be used for individuals having less experience, less strength, slower strokes, and/or for other purposes.

Using the paddle 150, therefore, a user such as an athlete may be better able to achieve their training goals. Because the paddle 150 may be used for different training goals and is, therefore, more flexible. Moreover, because the user may simply rotate and engage or detach than reattach the surface 152 and 160, the user's preparation for training is simplified. Further, because multiple resistances may be achieved with a single paddle 150, the user need not purchase, maintain, and transport multiple pieces of equipment for varied resistance training. In addition, greater specificity of exercise may also be provided. Consequently, cost and ease of use may be improved.

Figure 3:
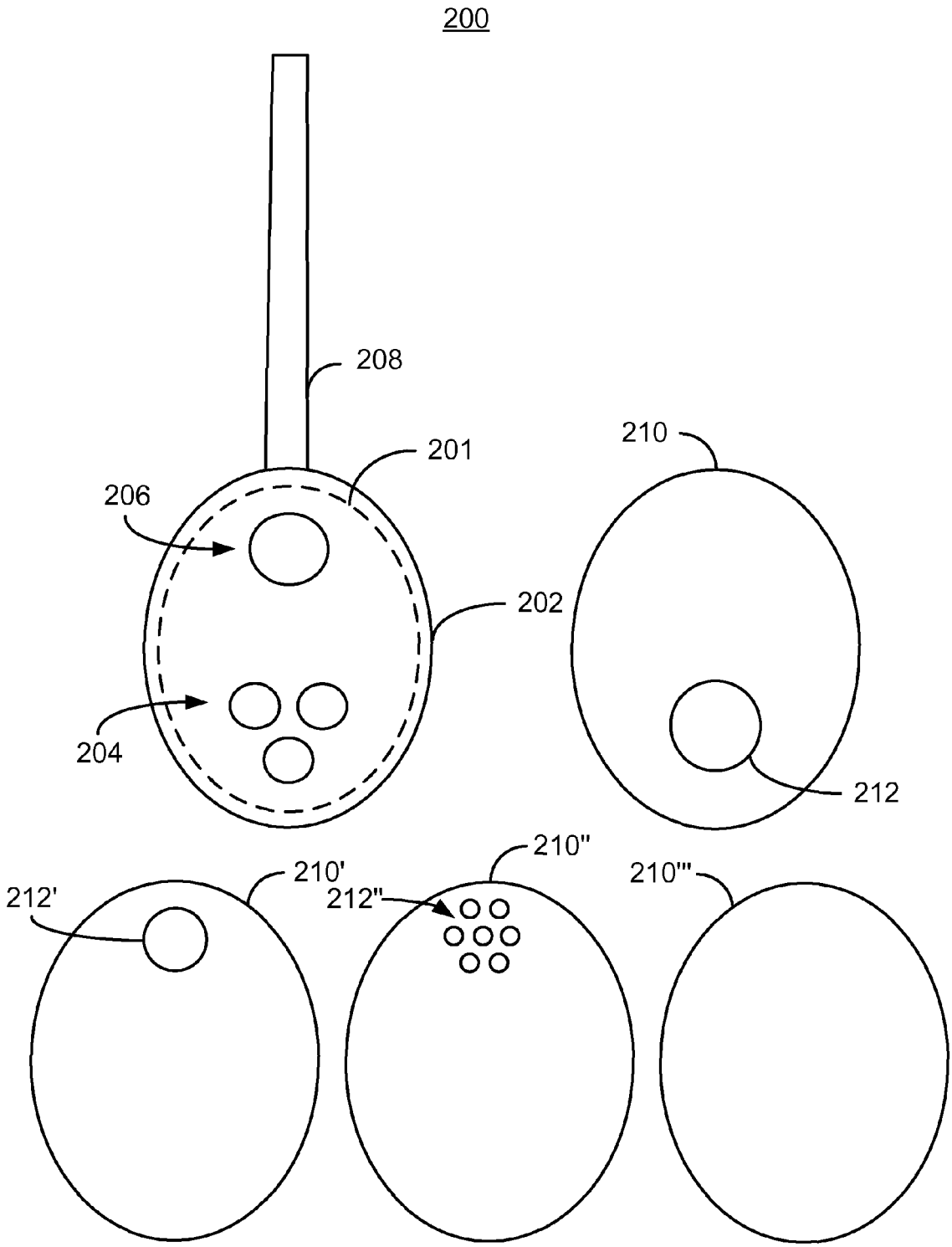
FIG. 3 depicts another exemplary embodiment of a paddle.

FIG. 3 depicts another exemplary embodiment of a paddle 200. The paddle 200 includes resistance surfaces 202 and a shaft 208. The paddle 200 also includes detachable/reattachable resistance surfaces 210, 210', 210", and 210'". In the embodiment shown, the resistance surface 202 is connected to/incorporated with the shaft 208. The paddle 200 may be a canoe paddle, a kayak paddle, a paddle-surfing paddle, surf ski paddle, or other paddle/oar.

The resistance surface 202 includes apertures 204 and apertures 206. In one embodiment, the resistance surface 202 is larger than a conventional paddle (not shown) that would be employed by the user of the paddle 200. For example, the dashed line 201 indicates the size of such a conventional paddle. However, in another embodiment, the resistance surface 202 is the same size as the conventional paddle. In an alternate embodiment, the resistance surface 202 might be smaller than that of a conventional paddle. In the embodiment shown, one set of apertures 204 includes three apertures, while the other 206 includes a single aperture. However, in another embodiment, another number of apertures, as well as another number of sets of apertures, might be used.

The resistance surfaces 210, 210', and 210" includes a single set of apertures 212, 212', and 212", respectively. However, the resistance surface 210'" has no aperture. The apertures 212 and 212' have different sizes, while there is a different number of apertures 212". The resistance surface 202 and the resistance surface 210 may be coupled in a variety of configurations. Depending upon the configuration and surface 210, 210', 210", or 210'" used, the paddle 200 may have a different resistance. For example, for the resistance surface 210, there are two configurations. In one configuration, the aperture 202 of the aperture 206 are aligned. In another configuration for the surface 210, the apertures 212 and 206 are aligned. These two configurations may have different resistances. The same is true for the resistance surface 210' and 210". However, for the resistance surface 210'" having no apertures, only one resistance configuration, the highest available, is provided. In one embodiment, each of the resistance surface 210, 210', 210", and 210'" may snap on or otherwise easily and securely be attached and detached from the resistance surface 202.

Based on which resistance surface 210, 210', 210", and 210" is used with the resistance surface 202 and which apertures 204 or 206 are aligned, the resistance provided by the paddle 200 may be changed. The resistances available are analogous to the resistance described for the paddles 100 and 150. For example, resistances as low as fifty percent and/or seventy-five through eighty percent of a conventional paddle and as high as one hundred twenty-five through one hundred-fifty percent of a conventional paddle may be obtained. In other embodiments, different resistances may be achieved. Consequently, similar benefits may be achieved. By utilizing the paddle 200 in one of the configurations, a user may achieve a variety of training goals. In particular higher resistances may allow for greater strength training while lower resistances may facilitate better fast twitch muscle/sprint training. Variations in resistances may also be used to achieved some combination of strength and speed results and/or be used for individuals having less experience, less strength, slower strokes, and/or for other purposes.

Using the paddle 200, therefore, a user such as an athlete may be better able to achieve their training goals. Because the paddle 200 may be used for different training goals and is, therefore, more flexible. Moreover, because the user may simply rotate and engage or detach than reattach the surface 202 and 200, the user's preparation for training is simplified. Further, because multiple resistances may be achieved with a single paddle 200, the user need not purchase, maintain, and transport multiple pieces of equipment for varied resistance training. In addition, greater specificity of exercise may also be provided. Consequently, cost and ease of use may be improved.

Figure 4:
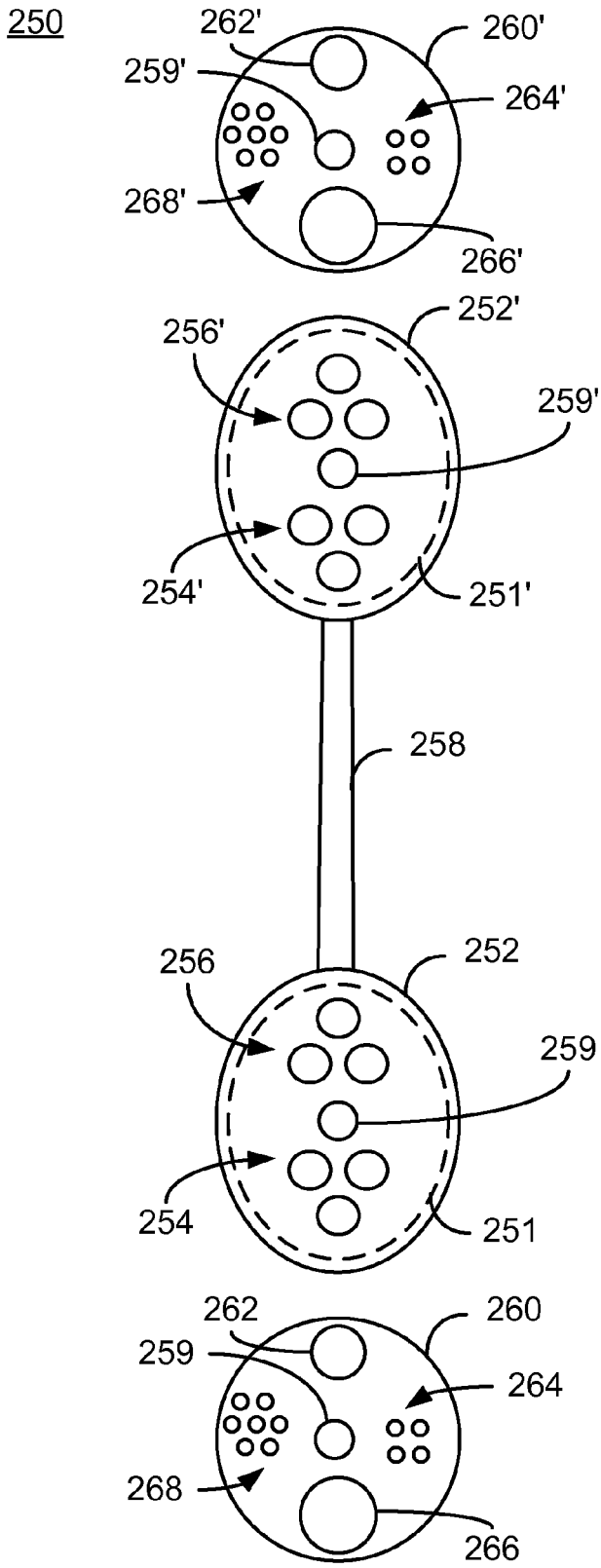
FIG. 4 depicts another exemplary embodiment of a paddle.

FIG. 4 depicts another exemplary embodiment of a paddle 250. The paddle 250 includes two resistance surfaces 202 and 202' coupled with a shaft 208. In the embodiment shown, both resistance surface 202 and 202' have varying resistance. However, in another embodiment, only one of the resistance surfaces 202 or 202' may have a variable resistance. In addition, although the configuration of the resistance surfaces 202 and 202' is the same in FIG. 4, in another embodiment, the surfaces 202 and 202' may be configured differently. For example, a different number and/or configuration of apertures might be provided. In the embodiment shown, the resistance surfaces 202/202' include apertures 206/206', apertures 204/204' and central regions 209/209'. In the embodiment shown, the resistance surfaces 202 and 202' are connected to the shaft 208. In another embodiment both of the resistance surfaces 202 and 210 may be coupled to coupled to or incorporate a shaft. In yet another embodiment, the resistance surface 210 may be coupled to the shaft 208. The paddle 200 is a double paddle that may, for example, be a kayak paddle, a surf ski paddle, or other paddle/oar.

The resistance surface 252 includes apertures 254 and apertures 256, and central region 259. The central region 259 may be used to rotatably couple the resistance surface 252 with the resistance surface 260. Similarly, the resistance surface 252' includes apertures 254' and 256' as well as central region 259'. The central region 259' is also used to rotatably couple the resistance surface 252' with the resistance surface 260'. In one embodiment, the resistance surfaces 252/252' are larger than a conventional paddle (not shown) that would be employed by the user of the paddle 250. For example, the dashed lines 251/251' indicate the size of such a conventional paddle. However, in another embodiment, the resistance surfaces 252/252' are the same size as the conventional paddle. In an alternate embodiment, the resistance surfaces 252/252' might be smaller than that of a conventional paddle. In the embodiment shown, each set of apertures 254/254' and 256/256' includes three apertures. However, in another embodiment, another number of apertures, as well as another number of sets of apertures, might be used.

The resistance surfaces 260/260' includes multiple sets of apertures 262/262', 264/264', 266/266', and 268/268' as well as a central region 269/269'. The central region 269/269' may house or couple with a shaft (not shown) used to rotatably couple the resistance surface 252/252' and 260/260', respectively. The apertures 262/262', 264/264', 266/266', and 268/268' have different sizes. The resistance surface 252 and the resistance surface 260 may be coupled in a variety of configurations. Similarly, the resistance surface 252' and 260' may be coupled in a variety of configurations. Further the configuration of the surfaces 252 and 260 may differ from the configuration of the surfaces 252' and 260'. The configurations that may be used are analogous to those discussed above with respect to the paddles 100,150, and 200.

In one embodiment, the resistance surfaces 252 and 260 are rotatably coupled through regions 259 and 269, respectively. Similarly, the resistance surfaces 252' and 260' may be rotatably coupled through regions 259' and 269', respectively. In such an embodiment, one resistance surface 252 or 260 may be rotated with respect to the other resistance surface 260 or 252, respectively, and then engaged when the resistance surface 260 and 252 is in the desired configuration. The same is true for the resistance surface 252' and 260'. In another embodiment, the alignment may be achieved by detaching the resistance surface 252 from the resistance surface 260, then reattaching the resistance surfaces 252 and 260 in the desired configuration. The resistance surface 252 and 260 may operate similarly.

Based on whether and which apertures are aligned, the resistance provided by the paddle 250 may be changed. The resistances available are analogous to the resistance described for the paddles 100, 150, and 200. Consequently, similar benefits may be achieved. Using the paddle 250, therefore, a user such as an athlete may be better able to achieve their training goals. Because the paddle 250 may be used for different training goals and is, therefore, more flexible. Moreover, because the user may simply rotate and engage or detach than reattach the surface 252 and 260, the user's preparation for training is simplified. Further, because multiple resistances may be achieved with a single paddle 250, the user need not purchase, maintain, and transport multiple pieces of equipment for varied resistance training. In addition, greater specificity of exercise may also be provided. Consequently, cost and ease of use may be improved.

Figure 5:
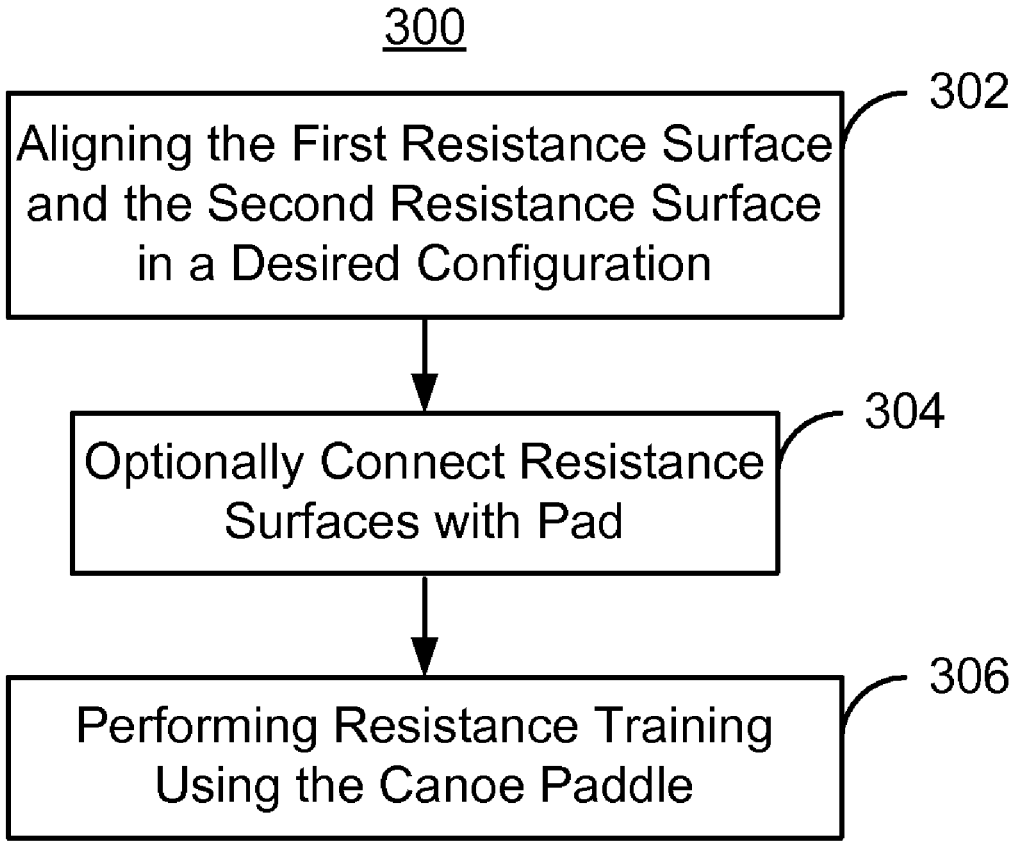
FIG. 5 depicts an exemplary embodiment of a method for utilizing a paddle.

FIG. 5 depicts an exemplary embodiment of a method 300 for utilizing a paddle. For simplicity, the method 300 is described in the context of the paddle 100. However, the method 300 may be used with other analogous paddles such as the paddles 150, 200, and/or 250. For clarity, some steps may be omitted and/or combined.

The first resistance surface 102 and the second resistance surface 110 are aligned in one of a plurality of configurations available, via step 302. In one embodiment, step 302 includes rotating one of the surface 102 or 110 with respect to the other surface 110 or 102, respectively, then engaging a locking or other mechanism to secure the positions of the surfaces 102 and 110. In another embodiment, step 104 may include attaching a free standing surface 110 with the surface 102. In one embodiment, step 302 includes aligning some portion of the aperture(s) 104, 112, 114, 116, and 118 of the surfaces 102 and 110 in the desired configuration. One such configuration might include having no apertures aligned such that the paddle 100 has the highest resistance.

If the resistance surfaces 102 and 110 are not already coupled with a shaft, then they may optionally be connected to the shaft, via step 304. Thus, the paddle 100, 150, 200, and/or 250 may be formed. Resistance training is performed utilizing the paddle 100/150/200/250, via step 306.

Using the method 300, the benefits of the paddles 100, 150, 200, and/or 250 may be achieved. In particular, strength and/or speed training may be performed using an apparatus that is flexible and simpler to maintain and use. In addition, greater specificity of exercise may be provided.

A method and system for a paddle has been disclosed. The method and system have been described in accordance with the embodiments shown, and one of ordinary skill in the art will readily recognize that there could be variations to the embodiments, and any variations would be within the spirit and scope of the present application. Accordingly, many modifications may be made by one of ordinary skill in the art without departing from the spirit and scope of the appended claims.

I claim:

1. A paddle comprising:

a first resistance surface including at least one aperture therein, the first resistance surface being substantially flat;

at least one second resistance surface, each of the at least one second resistance surface including a plurality of sets of apertures and coupled with the first resistance surface in a plurality of configurations, the plurality of configurations having a plurality of resistances, each of the plurality of sets of apertures configured to be selectively aligned with the at least one aperture, the plurality of sets of apertures having a different physical configurations, different resistances and corresponding to the plurality of configurations.

2. The paddle of claim 1 further comprising:

a shaft coupled with the first resistance surface and the at least the second resistance surface.

3. The paddle of claim 2 wherein the at least the second resistance surface includes a single resistance surface rotatably coupled with the first resistance surface.

4. The paddle of claim 2 wherein the paddle corresponds to a paddle having a particular resistance, the plurality of resistances being not less than fifty percent of the particular resistance and not more than one hundred fifty percent of the particular resistance.

5. The paddle of claim 4 wherein the plurality of resistances are not less than seventy-five percent of the particular resistance and not more than one hundred twenty-five percent of the particular resistance.

6. The paddle of claim 2 wherein the at least one aperture further includes a plurality of apertures.

7. The paddle of claim 1 wherein the first resistance surface has a center, the at least one aperture being located substantially at the center.

8. The paddle of claim 1 wherein the first resistance surface has a center, the at least one aperture being located distal from the center.

9. The paddle of claim 2 further comprising:

a third resistance surface including at least a second aperture therein, the third resistance surface coupled with the shaft;

at least a fourth resistance surface coupled with the third resistance surface in an additional plurality of configurations, the additional plurality of configurations having an additional plurality of resistances.

10. The paddle of claim 1 wherein the paddle is at least one of a canoe paddle and a kayak paddle.

11. A paddle comprising:

a first resistance surface including at least one aperture therein;

a second resistance surface including a plurality of sets of apertures and rotatably coupled with the first resistance surface in a plurality of configurations, the plurality of configurations having a plurality of resistances, each of the plurality of sets of apertures configured to be selectively aligned with the at least one aperture, each of the plurality of sets corresponding to one of the plurality of configurations the first and second resistance surfaces having different physical configurations; and a shaft coupled with the first resistance surface and the second resistance surface;

wherein the paddle corresponds to a paddle having a particular resistance, the plurality of resistances being not less than fifty percent of the particular resistance and not more than one hundred fifty percent of the particular resistance.

12. A method for utilizing a paddle including a first resistance surface and at least one second resistance surface, the method comprising:

aligning the first resistance surface and the second resistance surface in one of a plurality of configurations, the first resistance surface including at least one aperture therein, the plurality of configurations having a plurality of resistances, each of the at least one second resistance surface including a plurality of sets of apertures, the plurality of configurations having a plurality of resistances, each of the plurality of sets of apertures configured to be selectively aligned with the at least one aperture, the plurality of sets of apertures having different physical configurations, different resistances and corresponding to the plurality of configurations; and performing resistance training utilizing the paddle.

13. The method of claim 12 wherein the paddle further includes a shaft coupled with the first resistance surface and the at least the second resistance surface and wherein the resistance training performing further includes:

paddling utilizing the training apparatus.

14. The method of claim 12 wherein the at least the second resistance surface includes a single resistance surface rotatably coupled with the first resistance surface and wherein the aligning further include rotating the single resistance surface with respect to the resistance surface to provide the one of the plurality of configurations.

15. The method of claim 14 wherein the rotating further includes:

rotating the single resistance surface so that at least one of no aperture and one of the plurality of sets of apertures aligns with the at least one aperture.

16. The method of claim 12 wherein the paddle corresponds to a paddle having a particular resistance, the plurality of resistances being not less than fifty percent of the particular resistance and not more than one hundred fifty percent of the particular resistance and wherein the aligning further includes:

aligning the first resistance surface and the at least the second resistance surface to have a resistance of not less than fifty percent of the particular resistance and not more than one hundred fifty percent of the particular resistance and wherein the aligning further includes.

17. The method of claim 16 wherein the plurality of resistances are not less than seventy-five percent of the particular resistance and not more than one hundred twenty-five percent of the particular resistance.

18. The method of claim 12 wherein the paddle further includes a shaft coupled to the first resistance surface and the second resistance surface, a third resistance surface including at least a second aperture therein, the third resistance surface coupled with the shaft, and at least a fourth resistance surface coupled with the third resistance surface in an additional plurality of configurations, the additional plurality of configurations having an additional plurality of resistances, the method further including:

aligning the third resistance surface and the at least the fourth resistance surface in one of the additional plurality of configurations.

* * * * *